United States Patent [19]

Schampers et al.

[11] 4,030,789

[45] June 21, 1977

[54] METHOD OF MANUFACTURING AN ELECTRIC DISCHARGE TUBE

[75] Inventors: Paulus Philippus Maria Schampers; Pieter Adrianus De Rijke, both of Eindhoven, Netherlands

[73] Assignee: U.S. Philips Corporation, New York, N.Y.

[22] Filed: Sept. 27, 1976

[21] Appl. No.: 727,049

Related U.S. Application Data

[63] Continuation of Ser. No. 583,982, June 5, 1975, abandoned.

[30] Foreign Application Priority Data

June 14, 1974 Netherlands ..... 7407952

[52] U.S. Cl. ..... 316/19; 316/31

[51] Int. Cl.² ..... H01J 9/18

[58] Field of Search ..... 316/17, 18, 19, 20, 316/21, 31; 220/2.1 R

[56] References Cited

UNITED STATES PATENTS

| | | | |
|---|---|---|---|
| 3,038,731 | 6/1962 | Milleron | 285/10 |
| 3,334,955 | 8/1967 | Day | 316/19 |
| 3,853,374 | 12/1974 | Flasche | 316/19 |

*Primary Examiner*—Richard B. Lazarus
*Attorney, Agent, or Firm*—Frank R. Trifari

[57] ABSTRACT

In a method of manufacturing an electric discharge tube in which at least one of the components of the tube is subjected to a treatment in a vessel sealed from the atmosphere. The vessel consists of at least two parts which are sealed against each other with the interposition of a gallium-containing material in the liquid state. One of the parts of the vessel preferably forms a part of the final envelope of the discharge tube.

4 Claims, 6 Drawing Figures

METHOD OF MANUFACTURING AN ELECTRIC DISCHARGE TUBE

Figure 1:
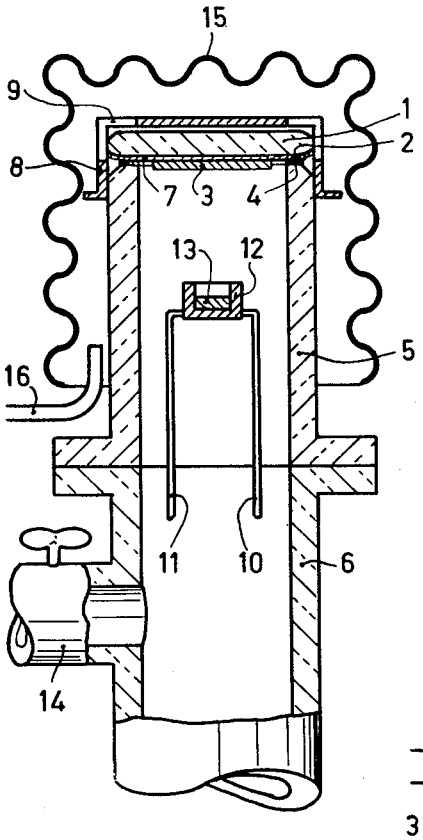

This is a continuation of application Ser. No. 583,982, filed June 5, 1975, now abandoned.

The invention relates to a method of manufacturing an electric discharge tube in which at least one of the components of the tube is subjected to an operation in a vessel sealed from the atmosphere, which vessel is composed of at least two parts to be sealed hermetically against each other.

The invention furthermore relates to an electric discharge tube manufactured by said method.

In the manufacture of electric discharge tubes it frequently occurs that certain components of the tube are to be subjected to operations which have an undesired and frequently detrimental influence on other components of the tube. For that reason is it desired that the components in question be subjected to the required treatments in separate spaces before they are assembled to form a tube. Moreover, the specific problem may occur that the components after their treatment may no longer be exposed to atmospheric influences. A known example hereof is found in the manufacture of electric discharge tubes having a given radiation-sensitive layer, for example, television camera tubes and photomultiplier tubes. It is known that the properties of the radiation-sensitive material with respect to, for example, the sensitivity or the inertia, can vary unfavourably when they are exposed to the atmosphere.

U.S. Pat. Spec. No. 3,334,955 describes a method of manufacturing a vacuum tube in which the components of the tube are assembled in an evacuated space after having been subjected in separate vessels to various treatments. Said vessels are temporarily sealed by a metal foil and are opened again in the evacuated space by cutting said foil from an annular frame.

German Pat. Spec. No. 1,915,710 describes a method of manufacturing a television camera tube in which a photocathode is vapour-deposted on a window in a closed vessel comprising said window. Said vessel together with the electrode system of the camera tube which is already mounted in an envelope which is open at one end, is then accommodated in a space communicating with an evacuating device. After evacuating the space, the system of electrodes is degassed, after which the window having a radiation-sensitive layer is removed from the said vessel by means of a thermoshock treatment and is then placed on the open end of the envelope of the camera tube with the interposition of an indium sealing ring.

The methods which are used in the know manufacturing techniques to obtain a temporary seal of the vessels are far from ideal. The seals can be used only once and require expensive and precise pre-treatment.

The invention starts from the above-described methods and has for its object to provide an improved method of manufacturing an electric discharge tube.

According to the invention, a method of manufacturing an electric discharge tube in which at least one of the composing parts of the tube is subjected to a treatment in a vessel which is sealed from the atmosphere and whose envelope consists of at least two parts which are sealed hermetically against each other, is characterized in that the said parts have smooth facing surfaces which, in order to obtain a hermetic seal, are arranged on each other with the interposition of a layer of gallium-containing material which in the liquid state is provided on at least one of the said surfaces.

Gallium has a melting temperature of approximately 29° C. In the liquid state, said metal can readily wet glass and other metals. Another property which is important for the use according to the invention is that gallium has a vapour pressure lower than $10^{-8}$ mm Hg even at a temperature of 500° C.

It is noted that seals of gallium are known as such from the U.S. Pat. Spec. No. 3,038,731, in particular with respect to liquid seals for valves and parts which are arranged so as to be rotatable relative to each other. As described in said Patent Specification, the sealing effect of gallium and low-melting point alloys of gallium is based on an equilibrium of forces between on the one hand the surface forces of the sealing material and on the other hand the force acting on said material as a result of the pressure differential across the seal. This equilibrium may exist so long as with a given pressure differential the distance between the surfaces of the parts to be connected does not exceed a given value. In the practical case in which the pressure differential across the seal is approximately one atmosphere, this means that the maximum distance of the parts to be connected may not be larger than approximately 10$\mu$m with a surface tension of the sealing material of approximately 500 dyn/cm.

Seals of gallium or a low-melting-point alloy of gallium can be realized in a particularly simple manner. The facing surfaces of the parts to be connected are first polished so as to ensure that said surfaces join each other within a tolerance of 10$\mu$m. At least one of the surfaces is then wetted with gallium or a low-melting-point alloy of gallium, after which the surfaces are provided on each other. According to the invention, the parts which are provided on each other are preferably rotated relative to each other so that a pattern of closed rings is formed in the sealing material. In this manner, the occurrence of radial leakage paths by island formation of the sealing material between the surfaces is prevented. The sealing as such is then completed and the space thus closed can be evacuated. The seal can easily withstand large temperature fluctuations. Temperatures exceeding 200° C hardly constitute a drawback, while a hermetic seal is also maintained if the sealing material changes into the solid phase as a result of a decrease of the temperature.

Not only can the above-described seal be realized in a simple manner, but parts of an envelope connected together in this manner can also be separated easily without damage thereto. It is thus these properties which make the seal extremely suitable for use as a temporary seal in the manufacture of electric discharge tubes in which at least one of the composing parts is subjected to a treatment in a vessel which is sealed from the atmosphere. According to the invention the envelope of said vessel preferably constitutes already wholly or partly the final envelope of the tube to be manufactured. According to the invention, the gallium or a low-melting-point alloy of gallium is also used for the final sealing of the tube.

Examples of low-melting-point alloys which satisfy the object underlying the invention are alloys of gallium and at least one of the metals indium and tin containing at least 50% by weight of Ga, and in particular catectic alloys of gallium, indium and tin the melting point of which is below room temperature.

The invention preferably relates to the manufacture of an electric device having a vapour-deposited layer of radiation-sensitive material sealed from the atmosphere. The part of the tube envelope to be provided with the radiation-sensitive material is for that purpose arranged on a vapour-deposition device with the interposition of a layer of gallium-containing material for the hermetic seal of a first vessel thus formed. The complementary part of the tube envelope comprising the electrode system of the tube is hermetically sealed in an analogous manner by means of a sealing member and thus constitutes a second vessel. The said first vessel and second vessel are then evacuated, after which the radiation-sensitive material is vapour-deposited in the first vessel and the electrode system is degassed in the second vessel. After vapour-depositing the radiation-sensitive material, the first vessel is filled with a gas which does not influence the radiation-sensitive material. When the pressures inside and outside the vessel are substantially equal to each other, the relevant part of the tube envelope may be removed from the vapour deposition device. In the second vessel the degassed electrode system is surrounded by an inert gas, after which the sealing member of the said complementary part of the tube envelope may be removed. Finally the part of the tube envelope having a radiation-sensitive layer is transferred to the complementary part of the tube envelope having the said electrode system. The gallium-containing material which is already present on the surfaces to be connected and which in the first instance ensured a temporary seal of the vessels, now produces the final seal of the tube.

During the transfer of the part of the tube envelope having a radiation-sensitive layer to the complementary part of the tube envelope, the radiation-sensitive material should be shiedled from atmospheric influences. Said shielding can be obtained in known manner by surrounding the relevant part during the transport with an inert gas, or causing the transport to take place in a vacuum space.

As is already known from the above-mentioned U.S. Pat. No. 3,038,731, measures are furthermore taken preferably to hold surfaces connected together hermetically with the use of a seal as described above in position relative to each other.

Figure 2:
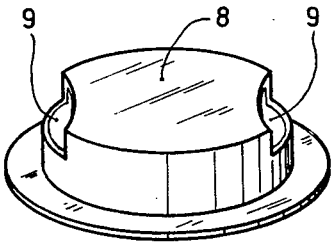
Figure 3:
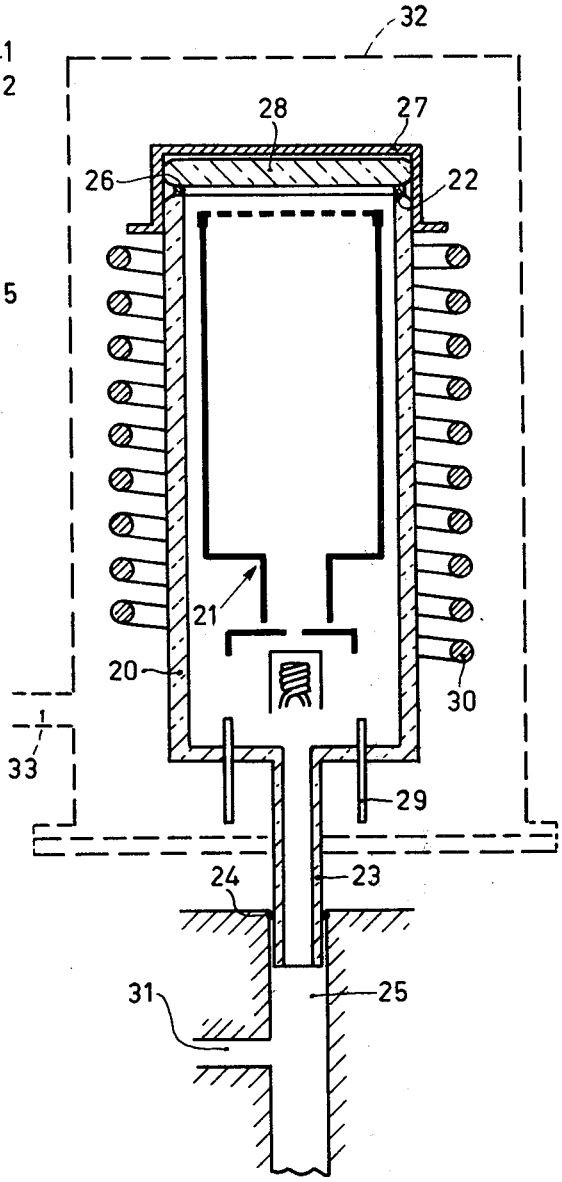
Figure 4:
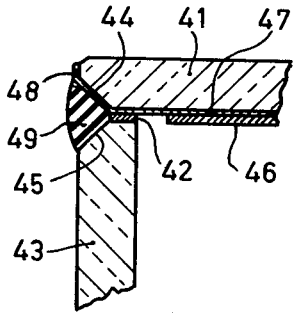
Figure 5:
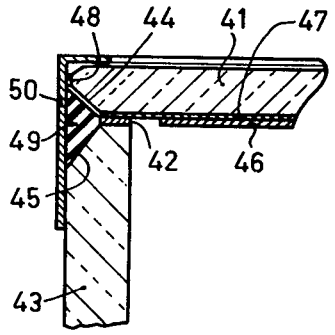
Figure 6:
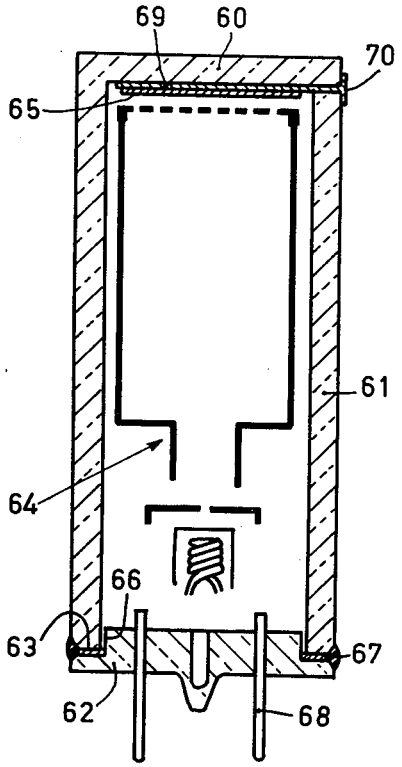

The invention will be described in greater detail with reference to the drawing, in which:

FIG. 1 is a diagrammatic sectional view of a device for vapour-depositing a layer of radiation-sensitive material on a part of the envelope of a television camera tube to be manufactured according to the invention, FIG. 2 is a perspective view of a centering holder for the part of the said envelope shown in FIG. 1, FIG. 3 is a diagrammatic sectional view of the complementary part of the part of the tube envelope shown in FIG. 1 and having a system of electrodes ready for degassing, FIGS. 4 and 5 are sectional views of two embodiments of a final seal of a television camera tube manufactured according to the invention, and FIG. 6 is a diagrammatic sectional view of a further embodiment of a television camera tube manufactured according to the invention.

FIGS. 1 and 3 show two stages of the manufacture of a television camera tube. The envelope of the tube consists of two complementary parts, namely a glass window 1 and a glass envelope 20 (FIG. 3) which is open at one end. In the stage shown in FIG. 1, a radiation-sensitive layer 3 of lead monoxide is vapour-deposited on the window 1.

Preparatory to said treatment, a layer of liquid gallium 2 is provided on a smooth polished edge 4 of a hollow cylinder 5. For that purpose, the edge 4 to be wetted is moved in a rotating manner on a heated flat plate on which a layer of liquid gallium of a few microns thickness is present, a layer of gallium 2 remaining on said edge 4. At its non-wetted end the cylinder 5 is then connected hermetically to a vacuum line 6 of an evacuating device now shown. The window 1 on which a transparent conductive layer 7 of tin oxide or indium oxide has already been vapour-deposited, is placed on the edge 4 by means of a centering holder 8 and rotated a few times so as to wet the surface of the window destined for the sealing. Moreover, due to the rotary movement, closed concentric rings are formed in the gallium so that possible radial leakgae paths are closed. In order to have a good grip on the window during said rotary movement two apertures 9 are recessed in the centering holder 8 a perspective view of which is shown in FIG. 2. By the arrangement of the window on the edge 4 with the interposition of a layer of gallium 2, a space is obtained which is sealed hermetically from the atmosphere and which is evacuated via the vacuum line 6. An electric current is now conveyed through the wires 10 and 11 so that a tray 12 filled with lead monoxide 13 is heated. The lead monoxide is vapour-deposited on the electrode 7 while forming the radiation-sensitive layer 3.

When the layer 3 has reached a thickness of approximately 8 microns, the vapour-deposition process is discontinued and the space bounded by the window 1 and the cylinder 5 is filled, via a closable supply line 14, with a gas, for example helium or nitrogen, which does not influence the radiation-sensitive material. Meanwhile, a pouch 15 manufactured from a synthetic material, for example, polythene, is slid on the cylinder 5 and is also filled with an inert gas, for example, helium or nitrogen, via a supply line 16, the air present in said pouch being driven out. After a pressure equal to or slightly larger than the ambient pressure has built up in the space communicating with the supply line 14, the window 1 may be removed from the cylinder 5 and be transported while protected by the inert gas present in the pouch, the opening of the pouch remaining directed downwards if the gas present therein is lighter than air.

Before placing the window 1 on the complementary part 20 of the envelope of the tube, the electrode system 21 already mounted in said part is degassed. This phase of the manufacturing process will be explained with reference to FIG. 3.

The glass part 20 of the envelope has a smooth polished edge 22 which is wetted with the gallium in the above described manner. Via an exhaust tube 23, the part 20 of the envelope is hermetically connected to a vacuum line 25 with the interposition of a sealing ring 24. An auxiliary window 28 is placed on the edge 22 in the above-described manner with the interposition of the layer of gallium 26 and by means of a centering holder 27. The space in which the electrode system 21 shown diagrammatically in the drawing is mounted on a number of pins 29 in the cap of the tube is hermetically sealed from the atmosphere. After evacuating said space, the assembly is heated in a furnace to a temperature of 250° C and the electrode system is then degassed at a temperature of 700° C by means of a high-frequency coil 30. After degassing, nitrogen is admitted to the said space through the duct 31 until the pressure in the space is equal to that of the surrounding atmosphere, after which the auxiliary window 28 may be removed from the part 20 of the envelope. The window 1 having a layer of lead monoxide is now placed on the edge 22 of the part 20 of the envelope. The nitrogen supply through the line 31 is discontinued and the gallium present on the surfaces of the window and envelope to be connected now serves for the final seal of the tube. The final envelope of the tube thus formed is finally evacuated via the line 25 after which the tube is completed.

In the case of large temperature fluctuations as they occur upon degassing the tube, no large temperature differences should arise between the window and the envelope of the tube since differences in expansion resulting therefrom may stimulate the formation of radial leakage paths in the seal. An improvement in this respect is obtained by replacing the centering holder 27 in this phase of the manufacturing process by a holder in which the apertures 9 are not provided. It is also possible, as is shown in broken lines in FIG. 3, to provide a temporary envelope 32 around the device to be degassed during firing, which envelope is pumped to a rough vacuum via a line 33, that is to say, a pressure of a few mm Hf. If desired, the firing temperature may then be increased from 250° C to 450° C without any objection, while in addition the lead through pins 29 are protected against possible oxidation.

In FIGS. 4 and 5 two embodiments of a completed gallium seal are shown in an enlarged scale. A window 41 is hermetically sealed against a cylinder 43 while using a gallium seal 42. Window and cylinder both have ground edges 44 and 45, respectively, which together constitute a V-shaped groove. A layer 46 of lead monoxide is vapour-deposited on a transparent signal electrode 47. The signal electrode 47 is led through to the exterior via a strip-shaped extension 48. In order to prevent a radial movement of the window 41, the groove formed by the ground edges 44 and 45 is filled with a hardening synthetic material 49.

The embodiment shown in FIG. 5 differs from that shown in FIG. 4 in that a metal ring is provided which covers the gallium seal and makes an electric contact with the extension 48 of the signal electrode 47. Since said ring locks the window against a radial movement, the filling of the V-shaped groove with a cement or hardening synthetic material 49 may be omitted.

The invention is not restricted to the above-described examples in which one of the complementary parts of the envelope of the tube is formed by a window. In the television camera tube shown diagrammatically in FIG. 6 the window 60 forms one assembly with the cylindrical envelope 61 while said cylindrical envelope is sealed hermetically on its open end against a closing plate 62 while using a gallium seal 63. The method of manufacturing said tube is analogous to that described with reference to FIGS. 1 and 3. Instead of an auxiliary window, an auxiliary envelope is used during the degassing of the electrode system 64 shown diagrammatically, while during transport the lead monoxide layer 65 formed on the window is protected against atmospheric influence by an inert gas, for example helium, admitted inside the envelope 61.

The closing plate 63 has a raised edge 66 to lock it, against a radial movement. If desired, the gallium seal 63 may be portected against atmospheric influences and dust by means of a synthetic material 67 or by means of a roof as described with reference to FIG. 5. Conductive pins 68 via which the various electrodes of the electrode system 64 can be brought at the desired potential are sealed in the closing plate. A transparent signal electrode 79 vapour-deposited on the window 60 is electrically led through the wall of the envelope 61 by means of a current supply conductor 70.

Photoelectric devices manufactured according to the above-described method have highly reproducible properties. The individual phases in the manufacturing process of the device can be carried out in conditions optimum for each phase. A further advantage is that no high temperatures are required either for producing or for disrupting the seals. As a result of this, not only the manufacturing process of the tube is simplified, but it is also prevented that temperature-sensitive components, for example, a radiation-sensitive layer, are detrimentally influenced.

What is claimed is:

1. A method of manufacturing an electric discharge tube of the type having, in an envelope composed of a first portion which is hermetically sealed to a second portion, a radiation sensitive layer on said first portion and a system of electrodes arranged opposite said radiation sensitive layer, comprising the steps of: forming said radiation sensitive layer on said first portion of the tube envelope in a first evacuated vessel which is temporarily closed by that first portion of the tube envelope using a liquid metal sealant of a gallium containing material, degassing the system of electrodes in a second evacuated vessel assembled of said second portion of the tube envelope and auxiliary closing member which are temporarily sealed together using a liquid metal sealant of said gallium containing material, filling said first and said second vessel with an inert gas at a pressure substantially equal to the ambient pressure on said vessels, disconnecting said first portion of the tube envelope from said first vessel and transporting said first portion to said second vessel, whereby the inert gas protects the radiation-sensitive layer on said first portion from exposure to the atmosphere during the transfer step, disconnecting the auxiliary closing member from said second vessel, sealing said first portion to said second portion of the tube envelope using a liquid metal sealant of said gallium containing material and evacuating the tube.

2. The method of claim 1, wherein said first portion of the tube envelope is a glass plate member and said second portion of the tube envelope is a glass cylindrical bulb which is open at one end and closed by a glass base supporting the system of electrodes at the other end, said bulb at its open end having an edge with a smooth sealing surface for joining an annular surface area of said plate member within a tolerance of approximately 10 microns.

3. The method of claim 1, wherein said first portion of the tube envelope is a glass cylindrical bulb which is open at one end and said second portion of the tube envelope is a glass base supporting the system of electrodes, said bulb at is open end having an edge with a smooth sealing surface for joining an annular surface area of said glass base within a tolerance of approximately 10 microns.

4. A method as claimed in claim 1, wherein the said gallium containing material is chosen from the group consisting of gallium; alloys of gallium and at least one of the metals indium and tin containing at least 50% by weight of gallium; and eutectic alloys of gallium, indium and tin the melting point of which is below room temperature.

* * * * *